US005320187A

United States Patent [19]

Pressley et al.

[11] Patent Number: 5,320,187

[45] Date of Patent: Jun. 14, 1994

[54] MECHANICAL LOCKOUT FOR A PNEUMATIC TOOL

[75] Inventors: Jack Pressley, Hudson, Ohio; John Knott, New Hartford, N.Y.; David M. Young, Frankfort, N.Y.; Pradip K. Paul, Whitesboro, N.Y.; Richard Wilusz, Utica, N.Y.

[73] Assignee: Chicago Pneumatic Tool Company, Utica, N.Y.

[21] Appl. No.: 993,417

[22] Filed: Dec. 21, 1992

[51] Int. Cl.[5] ..... B25D 17/10

[52] U.S. Cl. ..... 173/15; 173/168

[58] Field of Search ..... 173/13, 15, 168

[56] References Cited

U.S. PATENT DOCUMENTS

| | | | |
|---|---|---|---|
| 1,319,034 | 10/1919 | App | 173/15 |
| 1,586,865 | 6/1926 | Wade | 173/15 |
| 1,590,269 | 6/1926 | Wade | 173/15 |
| 1,915,071 | 6/1933 | O'Gorman | 173/15 |
| 3,950,625 | 4/1976 | Klebe, Jr. et al. . | |
| 4,006,786 | 2/1977 | Speicher . | |
| 4,546,833 | 10/1985 | Berecz et al. . | |
| 4,597,517 | 7/1986 | Wagdy . | |
| 4,846,287 | 7/1989 | Ericsson . | |
| 4,848,485 | 7/1989 | Piipponene et al. . | |

FOREIGN PATENT DOCUMENTS

| | | | |
|---|---|---|---|
| 455988 | 1/1928 | Fed. Rep. of Germany | 173/15 |
| 40882 | 2/1925 | Norway | 173/15 |
| 799442 | 8/1958 | United Kingdom | 173/15 |

*Primary Examiner*—Rinaldi I. Rada

*Attorney, Agent, or Firm*—Schmeiser, Morelle & Watts

[57] ABSTRACT

The invention is a safety mechanism for an air-powered tool. The mechanism senses the position of the tool's implement retainer and disables the air flow to the tool's motor if the retainer is not in its locked position. The mechanism employs a pushrod that has one end adapted to contact a rear surface of the retainer when the retainer is in its lock position. The other end of the pushrod is adapted to contact a spring-biased ball-type check valve located within the air inlet to the tool's motor. When the retainer is removed from the tool, the pushrod moves forwardly under the urging of the valve and at the same time allows the valve to move to its closed position to thereby prevent any flow of pressurized air to the motor.

20 Claims, 2 Drawing Sheets

MECHANICAL LOCKOUT FOR A PNEUMATIC TOOL

FIELD OF THE INVENTION

The invention is in the field of automatic shut-offs for power tools. More particularly, the invention is a pneumatic hammer that includes a lockout mechanism that can sense when the retainer for the tool's bit/work-contacting implement has been moved out of its fully-secured position. The mechanism includes a valve that is mounted within the tool and is capable of stopping the flow of pressurized air to the motor portion of the tool.

BACKGROUND OF THE INVENTION

A pneumatic tool such as an air hammer normally comprises three combined sections. The first section usually includes a handle for the manual manipulation of the tool. The tool's second section contains the air-powered motor. The third section of the tool comprises the retainer that removably secures the bit/implement that will directly contact the workpiece.

To operate the tool, a user grasps the tool's handle and then actuates a trigger mechanism that causes a valve within the tool to allow pressurized air to flow to the tool's motor. In the case of a pneumatic hammer, the air-powered motor is in the form of an elongated cylinder that houses a movable piston. The pressurized air is directed to opposite end portions of the cylinder in an alternating fashion to thereby cause a reciprocating movement of the piston within the cylinder. Whenever the piston reaches the bottom of the cylinder, it impacts on the removable bit/work-contacting implement.

The implement retainer is designed so that an operator can manipulate it to thereby allow the release or securement of the bit/work-contacting implement. For a pneumatic hammer, the retainer usually must be fully removed from the tool's housing before the bit/implement can be released.

There are two common methods for securing the implement retainer to the tool's housing. In the first method, the retainer is locked to the tool by a removable, flexible metal band that is sometimes referred to as a garter spring. The band fits through a hole in the retainer and is removably inserted into a circular area formed by complementary grooves on the interior of the retainer and on the exterior of the tool's housing. Once the band is in place, the retainer is locked onto the housing.

The second method for locking a pneumatic hammer's retainer to the housing is by the use of complementary threads located on the interior of the retainer and on the exterior of the tool's housing. These threads allow the retainer to be unscrewed from the tool and thereby removed.

A situation that can at rare times occur with air tools is the unintentional release or ejection of the work-contacting implement from the tool. Although the operator can avoid this hazard by inspection of the retainer prior to beginning work and by disconnection of the air supply when changing implements, it is desirable to further minimize the hazard which may be created by the inattention or neglect of the operator.

The above-noted situation can be dangerous if the tool's motor is actuated while the implement is not secured to the tool by the retainer.

It is therefore a common safety precaution to disconnect a tool from the air supply before removing the tool's implement retainer. However, since disconnecting the air supply is dependent upon the user, such user may negligently and incorrectly decide that disconnection is not necessary.

SUMMARY OF THE INVENTION

The invention is a lockout mechanism for a pneumatic tool. The mechanism is designed to detect when the work contacting implement is being removed and to disable the tool accordingly. The lockout mechanism is specifically designed for use with a pneumatic hammer to prevent the unintentional release of the bit/work-contacting implement from the tool when the retainer is not fully secured to the tool. The basic concept of the invention can be applied to other power tools that rely on a movable retainer to secure the work-contacting implement to the tool or that have a safety guard or other feature that can be removed (for example, the guard that partially surrounds the grinding wheel of a power grinder).

The lockout mechanism includes a detector that contacts the implement retainer or guard when the tool is in its normal operative condition. If the retainer or guard is moved to a position in which the tool cannot be safely operated, the detector disables the tool by causing a valve within the tool to block air from flowing to the tool's motor. In the preferred embodiment, the lockout mechanism further includes a movable check valve that is located in the air passage between the tool's trigger-operated valve and the diaphragm or cycling valve of the tool's motor.

The lockout mechanism's detector portion is in the form of a movable pushrod that extends through a bore located within the side of the tool's main housing. The pushrod is oriented so that one end will normally contact a rear portion of the tool's retainer or safety guard. The other end of the pushrod extends to the back of the tool proximate the tool's trigger-operated valve where it contacts either the tool's trigger valve or preferably, an added spring-biased safety valve.

The safety valve is located in the flow path of the high pressure air and consists of a ball that is constantly urged toward its seat by a spring. As long as the retainer or guard is in a normal implement locking position where the tool can be properly operated, the pushrod keeps the ball off the seat. When the retainer or guard is not in an appropriate operating position, the pushrod moves forwardly and allows the ball to move onto its seat, thereby stopping the flow of air to the tool's motor. In this manner, the lockout mechanism of the invention prevents the tool's motor from operating when the tool is in an inappropriate operating condition.

DETAILED DESCRIPTION OF THE DRAWINGS

Figure 1:
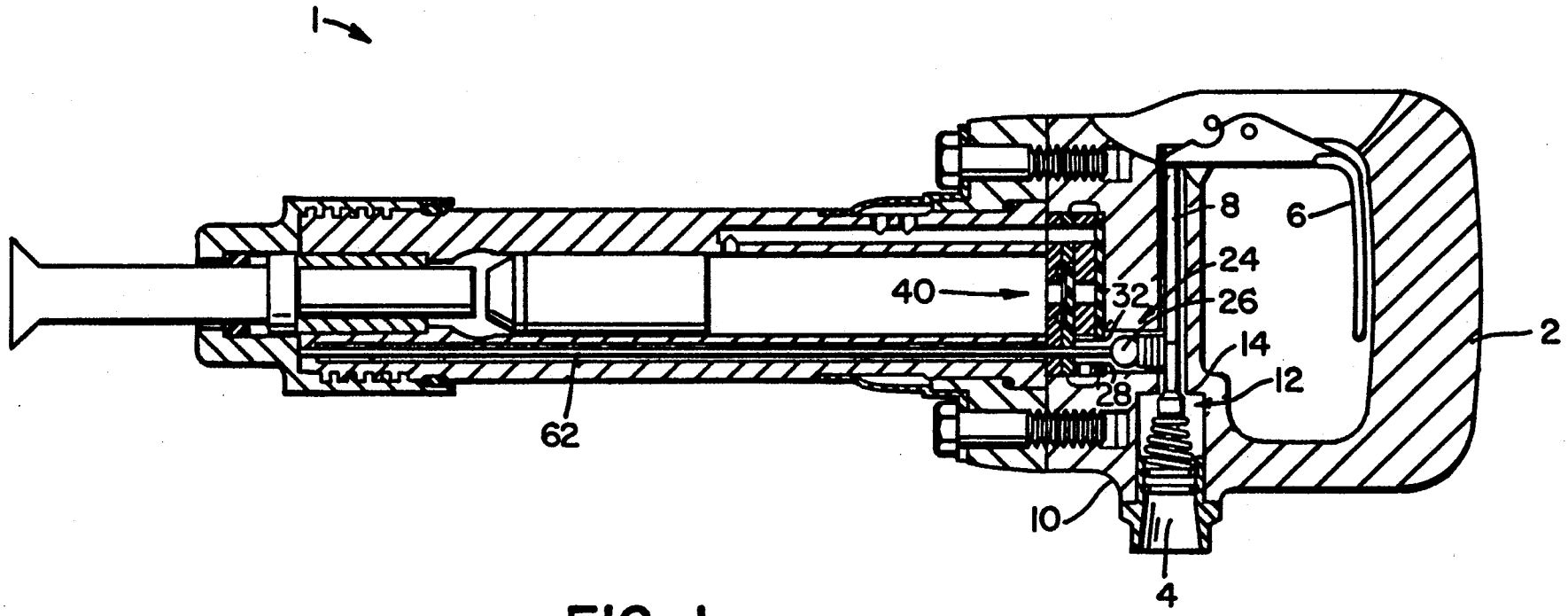
FIG. 1 is a side, cross-sectional view of a generalized pneumatic hammer.

Referring now to the drawings in greater detail, wherein like reference characters refer to like parts throughout the several figures, there is shown by the numeral 1 a side cross-sectional view of an air-powered impact hammer.

The hammer includes a handle 2 and an air inlet passage 4. Located within the perimeter of the handle is a manually actuable trigger 6. The trigger is connected to a throttle rod 8 that is located within the end housing 10.

The throttle rod 8 terminates at a throttle valve 12 that controls the air flow into the tool and is designed to shut-off the tool by stopping the air flow through passage 4. The valve's disk 14 is located at the end of the rod whereas the seat 16 is attached to the housing and is in the air flow path. A spring 20 biases the throttle valve toward a closed position.

The air path continues through passage 22 and past a ball-type safety check valve 24 that can also shut off the tool by stopping the air flow through the air flow path. Safety valve 24 comprises a ball 26 that is biased toward a circular seat 28 by a spring 30. The air will normally be able to continue past the ball and through the circular opening 32 within the seat. It should be noted that bore 34 in the housing 10 forms a portion of the air path and also constrains the ball 26 to a substantially linear path of travel.

Opening 32 is located on the outer surface of the case 36 of the tool's diaphragm or cycling valve structure 40. The cycling valve is basically of the standard type and directs the air either into the cylinder 42 above the piston 44 (causing a downward force on the piston) or into a passage (not shown) that leads to a port in the cylinder below the piston (causing an upward force on the piston). In this manner, the valve directs the air to cause a reciprocating motion of the piston within the cylinder. It should be noted that the cylinder is located at the center of the tool's main housing 46.

As described above, the piston, cylinder, cycling valve 40 and the related passage(s) that direct the air to the different portions of the cylinder together form the motor portion of the tool. It should also be noted that the cycling valve and safety valve are a combined unit with the case 36 of the cycling valve forming the base for the seat 28 of the safety valve. Therefore, the tool shown in FIGS. 1 and 2 has three valves in series; the throttle valve, safety valve, and cycling valve, with the latter two valves sharing common structure.

When the piston reaches the bottom of cylinder 42, it encounters the head 50 of the implement 52. The implement is removable from the tool and is designed to contact the workpiece (the structure or surface that is to be worked upon). While the implement shown is a chisel, it can be replaced by other well-known implements used to impart an impact force such as a hammer or punch.

A downward/outward force is imparted to the implement when the piston impacts on the head 50 of the implement 52. The implement can move a short distance within the tool before it is stopped by the retainer 54.

The retainer in the preferred embodiment is a cup-shaped member having a center thru-bore 56 which receives the upper portion of the implement. As shown, the end of the bore includes threads 58 that mate with exterior threads 60 of the main housing 46. When the retainer is fully secured on the housing, as shown in FIG. 1, it is in a lock position in which it secures or locks the implement 52 to the tool housing 46 in its designed manner.

Figure 2:
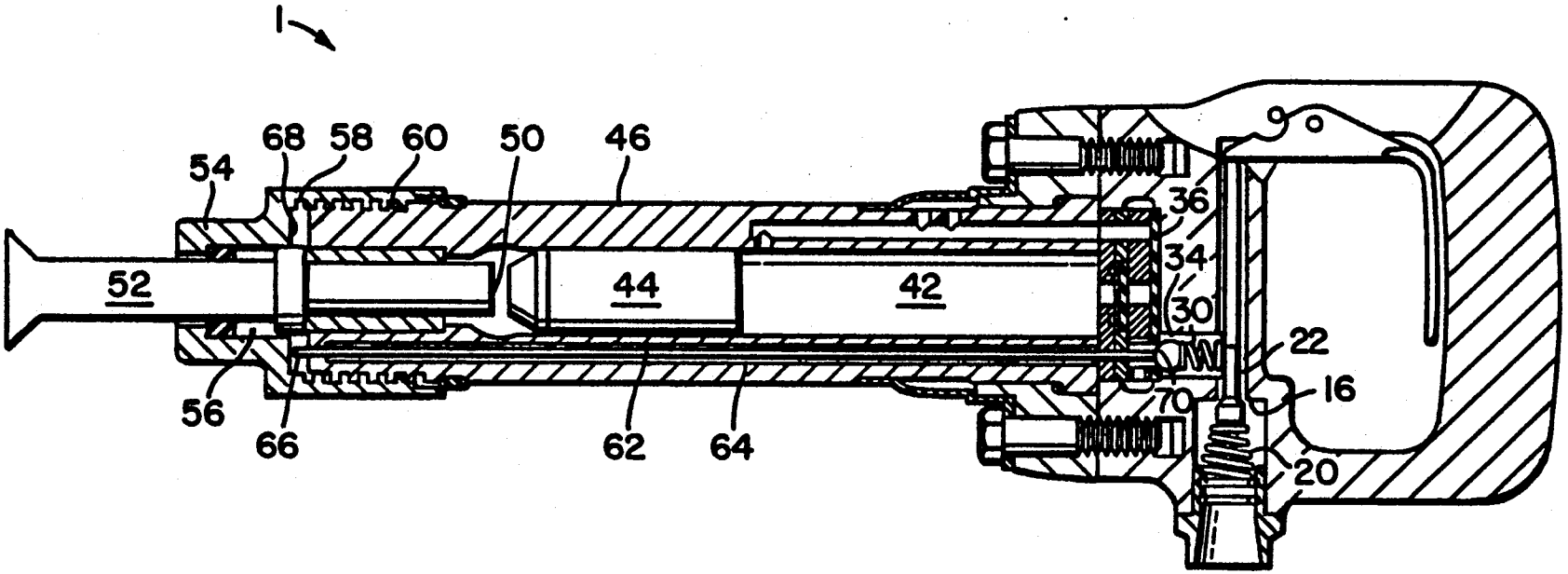
FIG. 2 is a side, cross-sectional view of the hammer shown in FIG. 1 with the implement retainer in a partially removed condition.

As can be seen in FIGS. 1 and 2, a pushrod 62 is movably received within a passage 64 in the main housing 46. The pushrod has one end 66 that is designed to contact a flat rear surface 68 of the retainer 54. The pushrod's other end 70 has either a flat or cupped outer surface and contacts one side of the ball 26 of the safety valve. The pushrod is preferably made of a rigid material such as steel. The pushrod may alternatively be manufactured from a flexible wire-like material as long as the retaining bore or passage 64 prevents significant sideways movement of the pushrod. When a flexible pushrod is employed, the retaining passage does not have to be straight, thereby allowing the invention to be employed in tools that do not structurally allow a straight run for the pushrod.

FIG. 1 shows the impact hammer 1 in its normal condition with the retainer securing the implement 52 to the tool in a proper, operative condition. End 66 of the pushrod is in contact with the rear surface 68 of the retainer, and is thereby pushed to a rearward position against the bias of spring 30. End 70 of the pushrod thereby acts on the ball 26 of the safety valve to maintain it in a raised position away from its seat 28.

In FIG. 2, the retainer has been partially removed from the end of the main housing. As the retainer is moved away from the housing, the pushrod follows it due to the action of spring 30 of the safety valve. This continues until ball 26 contacts the seat. It should be noted that should spring 30 fail, activation of the throttle valve 12 would initiate air flow that would bias the ball against the seat thereby closing the safety valve. In such a situation, the amount of air moving through the valve before the valve is closed is minuscule and would not provide sufficient force to propel the bit/work-contacting implement. Once the ball is on the seat, the safety valve is in its closed position and prevents any air from traveling through opening 32 and reaching the diaphragm valve 40 of the motor. It should be noted that the pushrod will only move outwards a distance substantially equal to the distance ball 26 travels before it reaches the seat 28. In this manner, the pushrod extends outwardly only a short distance from the housing, thereby minimizing the chance of inadvertent damage to its end 66.

While the preferred embodiment of the invention has been shown and described, there are a number of modifications that can be made to the basic structure without departing from the concept of the invention. For example, the ball 26 and complementary seat 28 of the safety valve can be made from a number of different materials. Preferably, a hard ball made from steel is used in combination with a seat made from a resilient material. The choice of materials can be reversed and a soft rubber ball can be used with a hard metallic seat. Other embodiments of the invention can employ different types or designs for the safety valve such as the use of a globe valve, reed valve or other well-known valve structures in which movement of a rod can cause closure of the valve. In addition, it is within the scope of the invention to eliminate entirely the added safety valve and instead have the push rod directly engage the tool's throttle valve to lock it in a closed position whenever the retainer has been moved from the position where it secures the bit (for example, the end of the pushrod can be shaped to engage the throttle rod 8 when the pushrod moves forwardly).

The primary embodiment of the invention disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A power tool comprising:

an elongated housing having a user graspable handle proximate a first end;

a removable member connected by fastening means to a second end of said housing, said removable member having a thru-bore and an implement retaining means, wherein when an implement adapted for contacting a workpiece is placed within the thru-bore of the removable member and the removable member is connected to the housing, the implement retaining means functions to releasably retain said implement to said housing while allowing said implement to move within the thru-bore of the removably member and wherein during normal operation of the tool, said removable member remains fixed to the housing and is stationary relative to the housing;

a motor means located within said housing between the housing's first and second ends, said motor means functioning to transform inputed power to a reciprocating movement that is imparted to the implement; and a stop means comprising a rod means, a follower means and a power shut-off means, said rod means being movably retained within a bore in said housing and wherein the rod means has a first end that contacts the removable member when said member is in a first position, and wherein said rod means has a second end that contacts the power shut-off means and wherein when said removable member is moved to a second position, the follower means causes the rod means to at least partially follow the movement of the removable member and to thereby cause the power shut-off means to be in a position wherein it prevents the input of power to the motor means.

2. The tool of claim 1 wherein the tool has an air inlet through which pressurized air may enter the tool, said air inlet extending to the motor means and having a control valve that is operable by a user to control the amount of pressurized air that is inputted to the motor means.

3. The tool of claim 2 wherein the power shut-off means of the stop means comprises a safety valve located in the air inlet between the control valve and the motor means, said safety valve being capable of stopping pressurized air from reaching the motor means and wherein said safety valve is in operative contact with the second end of the rod means.

4. The tool of claim 1 wherein the rod means is in the form of an elongated, flexible member.

5. An improved tool of the type having a pneumatically-powered motor, a throttle valve in an air inlet line leading to the motor, a handle means and an implement retainer that is removably attached by fastening means to an end of the motor, said implement retainer having an implement retaining means whereby when an implement adapted for contacting a workpiece is placed within the thru-bore of the implement retainer and the implement retainer is connected to the motor, the implement retaining means functions to retain the implement to the motor while allowing the implement to move within the thru-bore of the implement retainer and wherein during normal operation of the tool, said implement retainer remains fixed to the motor and is stationary relative to the motor, the improvement comprising:

a safety shut-off means that is dependent on the position of the implement retainer and includes a movable pushrod, wherein when the retainer is moved out of its lock position, the pushrod moves from a first position to a second position and the safety shut-off means prevents pressurized air from being inputted to the motor.

6. The tool of claim 5 wherein the safety shut-off means further comprises a valve located in the tool's air inlet line between the throttle valve and the tool's motor.

7. The tool of claim 6 wherein the valve of the safety shut-off means is spring biased toward a closed position and wherein the pushrod contacts a portion of said valve and maintains the valve in an open position when the retainer is in its lock position.

8. The tool of claim 7 wherein the valve of the safety shut-off means is in the form of a ball that is constrained to move within a cylindrical housing and can contact a circular seat and wherein when the ball contacts said seat, it blocks the flow of air through the tool's air inlet line.

9. The tool of claim 8 wherein the retainer has a flat rear surface adapted for contact with a first end of the pushrod.

10. The tool of claim 9 wherein the pushrod has a second end that contacts the ball of the safety shut-off means.

11. The tool of claim 10 wherein the tool is an impact hammer that has a motor in the form of a reciprocating piston within a cylinder and wherein the pushrod is oriented parallel to said cylinder.

12. The tool of claim 11 wherein the tool has an exterior housing having a handle located at a first end and having exterior threads located at a second end and wherein the retainer is cup-shaped and has interior threads at one end designed to mate with the exterior threads of the housing.

13. A pneumatic tool comprising:

a motor in the form of a piston movably contained within a cylinder and including means for directing pressurized air to opposite ends of said piston to thereby cause the piston to travel upwardly or downwardly within said cylinder;

a handle operatively attached to a first end of the cylinder;

an air inlet leading from an exterior source of pressurized air to the motor;

a control valve in the air inlet for controlling a flow of pressurized air to the motor;

an implement retainer connected to a second end of the cylinder and movable therewith in a manner wherein during normal operation of the tool, said implement retainer remains fixed to the cylinder and is stationary relative to the cylinder, said implement retainer having a thru-bore and an implement retaining means, and wherein when an implement adapted for contacting a workpiece is placed within the thru-bore of the retainer and the retainer is connected to the housing, the implement retaining means functions to retain said implement to the cylinder while allowing said implement to move within the thru-bore of the retainer, and wherein the retainer will normally be in a locking first position in which it fully secures the implement to the tool so that when the piston moves to a position at a bottom portion of the cylinder, it imparts a downward force on the implement, and wherein the retainer can be moved to a non-locking second position in which the implement is not fully secured to the tool and wherein when the retainer is located in its lock position, it is proximate a bottom end of the cylinder and wherein when the retainer is moved to its non-locking position, the distance between it and the cylinder is increased; and a safety shut-off means that is functionally dependent on the position of the implement retainer and includes a detecting means that senses the position of the retainer and wherein the safety shut-off means includes a stop means that prevents pressurized air from causing downward movement of the piston when the retainer is not in its lock position.

14. The tool of claim 13 wherein the air-flow stop means is in the form of a safety valve located in the tool's air inlet between the control valve and the motor.

15. The tool of claim 14 wherein the safety valve of the air-flow stop means is spring biased toward a closed position and wherein the detecting means is in the form of a spring-biased rod that contacts the retainer and a portion of said safety valve, and maintains said valve in an open position when the retainer is in its lock position and wherein said rod moves when the retainer is moved from its first position to its second position.

16. The tool of claim 15 wherein the safety valve of the air-flow stop means is in the form of a ball that is constrained to move within a cylindrical housing and can contact a circular seat and wherein when the ball contacts said seat, it blocks the flow of air through the air inlet.

17. The tool of claim 16 wherein the motor includes a cycling valve and wherein a portion of the cycling valve forms a base for the seat of the safety valve.

18. The tool of claim 16 wherein an end of the rod of the detecting means contacts the ball of the safety valve.

19. The tool of claim 18 wherein the tool has an exterior housing that has the handle means located at a first end and has exterior threads located at a second end and wherein the retainer is cup shaped and has interior threads at one end that mate with the exterior threads of the housing.

20. A power tool comprising:

an elongated housing having a user graspable handle proximate a first end;

a removable member connected by fastening means to a second end of said housing, said removable member having a thru-bore and an implement retaining means, wherein when an implement adapted for contacting a workpiece is placed within the thru-bore of the removable member and the removable member is connected to the housing, the implement retaining means functions to releasably retain said implement to said housing while allowing said implement to move within the thru-bore of the removably member and wherein during normal operation of the tool, said removable member remains fixed to the housing and is stationary relative to the housing and wherein the removable member will normally be in a locking first position in which it fully secures the implement to the tool, and wherein the removable member can be moved to a non-locking second position in which the implement is not fully secured to the tool;

a motor means located within said housing between the housing's first and second ends, said motor means functioning to transform inputed power to a movement that is imparted to the implement; and a safety shut-off means that is functionally dependent on the position of the removable member and includes a detecting means that senses the position of the removable member and wherein the safety shut-off means includes a stop means that prevents power from being imparted to the implement when the removable member is not in its lock position.

* * * * *